US008183781B2

(12) United States Patent
Lin et al.

(10) Patent No.: US 8,183,781 B2
(45) Date of Patent: May 22, 2012

(54) FLUORESCENT LAMP WITH ADJUSTABLE COLOR TEMPERATURE

(75) Inventors: Shih-Hsien Lin, Taoyuan Hsien (TW); Maw-Chuan Lin, Taoyuan Hsien (TW); Kung-Tung Pan, Taoyuan Hsien (TW); Mei-Huei Huang, Taoyuan Hsien (TW); Wei-Chung Cheng, Taoyuan Hsien (TW)

(73) Assignee: Delta Electronic, Inc., Kuei San, Taoyuan Hsien (TW)

( * ) Notice: Subject to any disclaimer, the term of this patent is extended or adjusted under 35 U.S.C. 154(b) by 318 days.

(21) Appl. No.: 12/240,504

(22) Filed: Sep. 29, 2008

(65) Prior Publication Data

US 2010/0001642 A1 Jan. 7, 2010

(30) Foreign Application Priority Data

Jul. 4, 2008 (TW) ..... 97125155 A

(51) Int. Cl.
*H01J 61/30* (2006.01)

(52) U.S. Cl. ..... 313/634; 313/631; 313/633

(58) Field of Classification Search ..... 313/627–643, 313/25, 26.3, 318.01–318.12, 567; 445/22, 445/26–27; 439/226

See application file for complete search history.

(56) References Cited

U.S. PATENT DOCUMENTS

| | | | | |
|---|---|---|---|---|
| 1,808,880 | A * | 6/1931 | Berger | 40/432 |
| 5,811,925 | A * | 9/1998 | Anandan et al. | 313/493 |
| 5,834,889 | A * | 11/1998 | Ge | 313/493 |
| 2002/0024815 | A1 * | 2/2002 | Haenen et al. | 362/341 |
| 2004/0108814 | A1 * | 6/2004 | Tsuda et al. | 313/634 |
| 2005/0231944 | A1 * | 10/2005 | Doll et al. | 362/231 |

* cited by examiner

*Primary Examiner* — Tracie Y Green
(74) *Attorney, Agent, or Firm* — Muncy, Geissler, Olds & Lowe, PLLC

(57) ABSTRACT

A fluorescent lamp includes at least two lighting elements, which emit lights with different color temperatures. In addition, the lighting illuminations of the lighting elements can be controlled by independent driving devices. Thus, the user can adjust the color temperature of the light emitted from the fluorescent lamp.

17 Claims, 5 Drawing Sheets

FLUORESCENT LAMP WITH ADJUSTABLE COLOR TEMPERATURE

CROSS REFERENCE TO RELATED APPLICATIONS

This Non-provisional application claims priority under 35 U.S.C. §119(a) on Patent Application No(s). 097125155 filed in Taiwan, Republic of China on Jul. 4, 2008, the entire contents of which are hereby incorporated by reference.

BACKGROUND OF THE INVENTION

1. Field of Invention

The present invention relates to a fluorescent lamp and, in particular, to a fluorescent lamp that can adjust the color temperature of the light emitted therefrom.

2. Related Art

Recently, the energy saving awareness has become one of the hottest topics. For example, the traditional incandescent light bulbs have been substituted by the energy saving light bulbs gradually. The energy saving light bulbs in the market usually has a base and a spiral hot cathode lamp installed on the base. The appearance of the energy saving light bulb is similar to that of the traditional incandescent light bulb so that the energy saving light bulb can be used in the original lamp holder.

FIG. 1 shows a conventional energy saving light bulb 10 having a lamp 11 with a spiral structure. Two electrodes 12 are installed at two ends of the lamp 11 for connecting to the driver 13. The driver 13 is disposed inside a shell 14, and the shell 14 has a head 15 for coupling to an external lamp holder (not shown). Thus, the lamp holder can apply electric power to the driver 13. In addition, a cover 16 is disposed around the lamp 11 and connected to the shell 14.

However, the energy saving light bulb of FIG. 1 can only emit the light with a single color temperature, which is determined according to the fluorescent material disposed in the lamp 11. Thus, if the light source with different color temperature is needed, the light bulb must be changed, which causes inconveniences in usage.

SUMMARY OF THE INVENTION

In view of the foregoing, the present invention is to provide a fluorescent lamp that can emit lights with different color temperatures.

To achieve the above, the present invention discloses a fluorescent lamp with adjustable color temperature. The fluorescent lamp includes at least two lighting elements and at least two driving devices connected to the lighting elements, respectively. The lighting elements are tube-shaped and have spiral structures with the same spiral cycle number and spiral diameter. The driving devices are disposed inside a base, and the lighting elements are spirally interlaced with each other.

The lighting elements can be made of glass tubes, and the fluorescent materials, which can emit lights of different colors, are coated on the inner surface of the glass tubes. In addition, the driving devices can control the lighting illuminations of the lighting elements, respectively. Thus, the color temperature of the light emitted from the fluorescent lamp of the present invention can be adjusted.

In addition, the fluorescent lamp of the present invention further includes a cover connected to the base. The cover includes a semiopaque material or diffusion particle(s) for prompting the light mixing of the lights emitted from the at least two lighting elements.

As mentioned above, the fluorescent lamp of the present invention utilizes two driving devices to independently control the lighting illuminations of at least two lighting elements, so that the color temperature of the light emitted therefrom can be adjusted.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
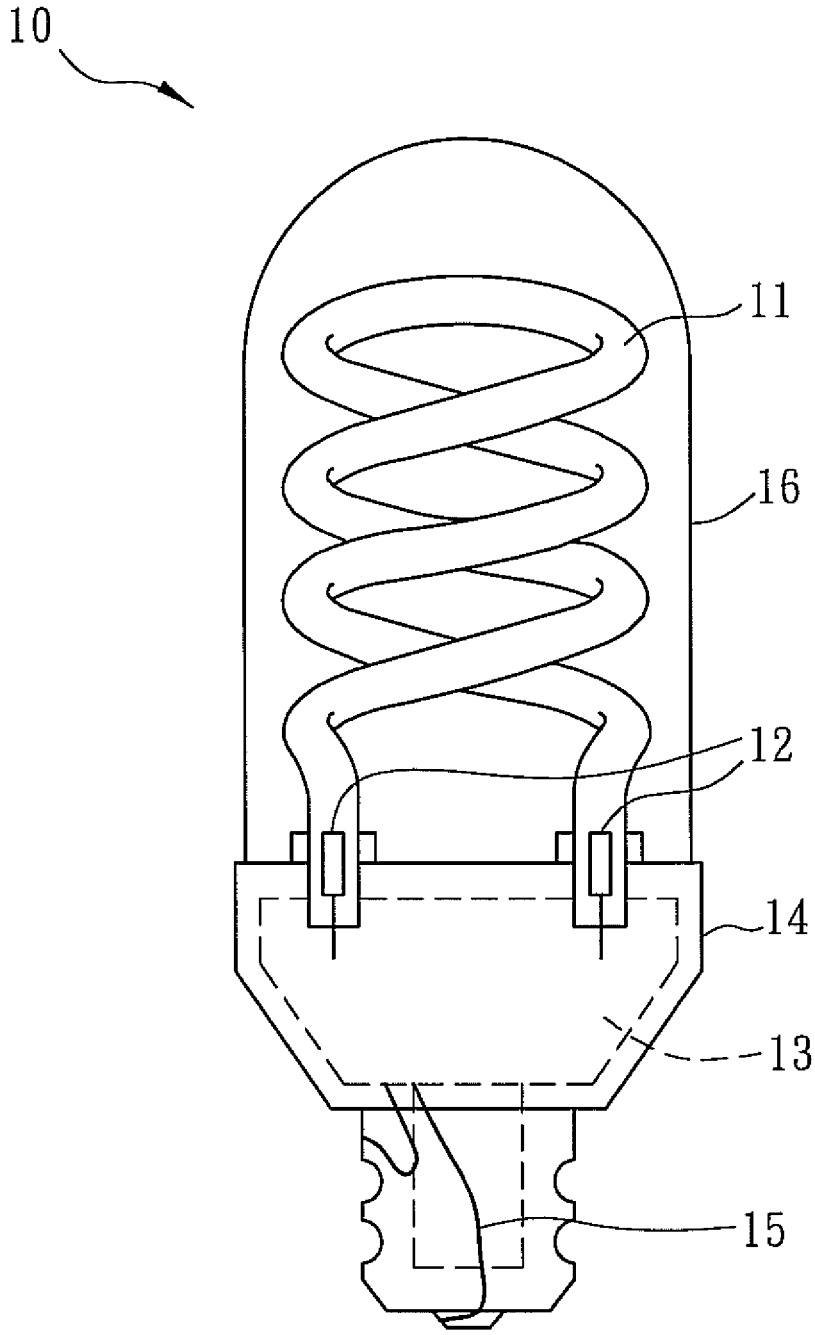
FIG. 1 (Prior Art)
FIG. 1 is a schematic illustration showing a conventional light bulb.
Figure 2A:
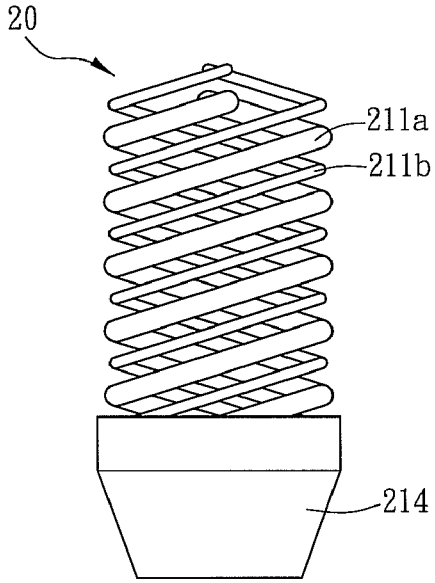
FIGS. 2A-D are schematic illustrations showing an aspect of a fluorescent lamp according to an embodiment of the present invention.
Figure 2B:
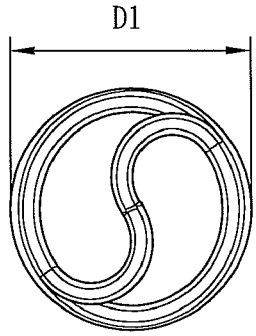
Figure 2C:
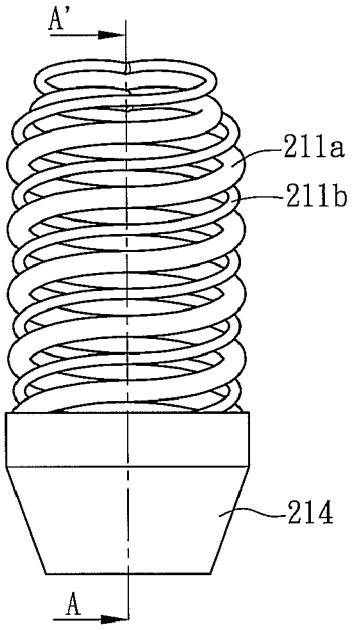
Figure 2D:
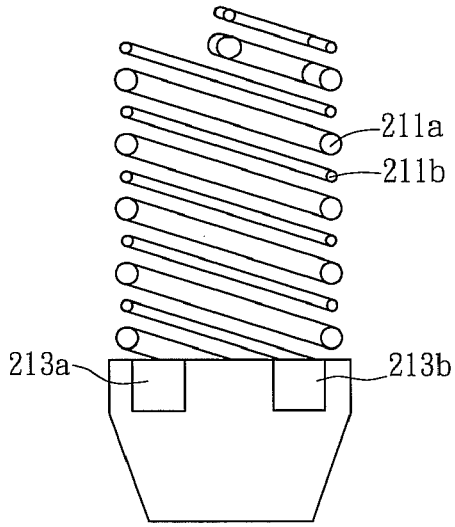

FIGS. 2A, 2B, 2C and 2D are schematic illustrations showing an aspect of a fluorescent lamp according to an embodiment of the present invention. FIG. 2A shows a front view of the fluorescent lamp, FIG. 2B shows a top view of the fluorescent lamp, FIG. 2C shows a side view of the fluorescent lamp, and FIG. 2D shows a sectional view along the line AA' of FIG. 2C. Referring to FIG. 2A, a fluorescent lamp 20 includes a first lighting element 211*a* and a second lighting element 211*b*. The first and second lighting elements 211*a*, 211*b* are both made of a glass tube, which has a tube diameter ranging from 1.8 to 40 mm. The first and second lighting elements 211*a*, 211*b* have spiral structures with the same spiral cycle number and spiral diameter, and both of which are spirally interlaced with each other. As shown in FIG. 2D, the first lighting element 211*a* is connected to a first driving device 213*a*, and the second lighting element 211*b* is connected to a second driving device 213*b*. The first and second driving devices 213*a*, 213*b* are disposed on a base 214 so as to couple to an external power source through the base 214. In the embodiment, the lighting element can be a hot cathode lamp or a cold cathode lamp.

The inner surfaces of the first and second lighting elements 211*a*, 211*b* are coated with fluorescent materials, which can emit lights of different colors. For example, when the first lighting element 211*a* emits the light with the color temperature of 2800° K, the second lighting element 211*b* emits the light with the color temperature of 6500° K. In the fluorescent lamp 20, the first and second driving devices 213*a*, 213*b* can control the first and second lighting elements 211*a*, 211*b*, respectively. Thus, the light emitted from the fluorescent lamp 20 can be a mixed light with the color temperature between 2800° K and 6500° K.

The first and second lighting elements 211*a*, 211*b* preferably have the same spiral diameter D1 and spiral cycle number. Thus, the lights emitted by the first and second lighting elements 211*a*, 211*b* are not blocked by one another so that the effect of uniformly mixing the lights can be achieved.

As shown in FIG. 2A, the tube diameter of the first lighting element 211*a* is different from that of the second lighting element 211*b*.

Figure 3B:
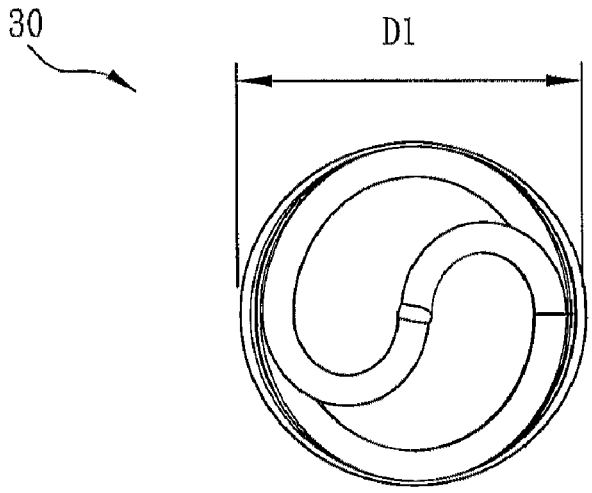
FIGS. 3A-B are schematic illustrations showing another aspect of the fluorescent lamp according to the embodiment of the present invention.
Figure 3A:
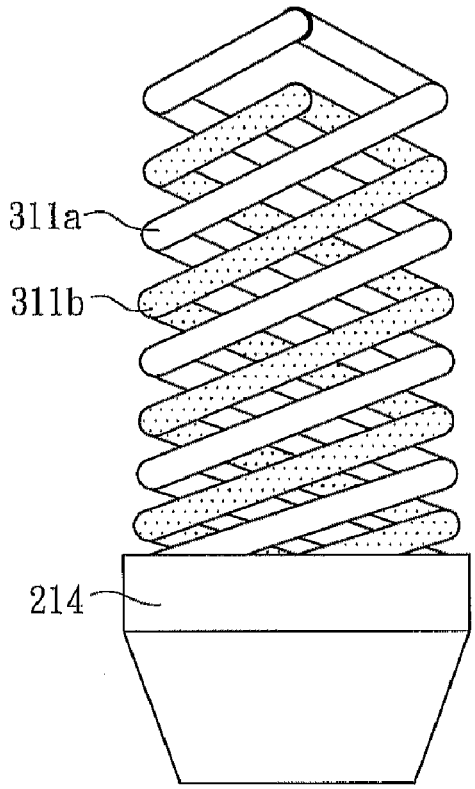

FIGS. 3A and 3B are schematic illustrations showing another aspect of a fluorescent lamp 30 according to the embodiment of the present invention. FIG. 3A shows a front view of the fluorescent lamp 30, and FIG. 3B shows a top view of the fluorescent lamp 30. The fluorescent lamp 30 of FIG. 3A is similar to the fluorescent lamp 20 of FIG. 2A, and the difference therebetween is in that the first lighting element 311*a* and the second lighting element 311*b* of the fluorescent lamp 30 have the same tube diameter. Since the other features of the fluorescent lamp 30 are the same as that of the fluorescent 20 of FIG. 2A, the detailed description thereof will be omitted.

Figure 4:
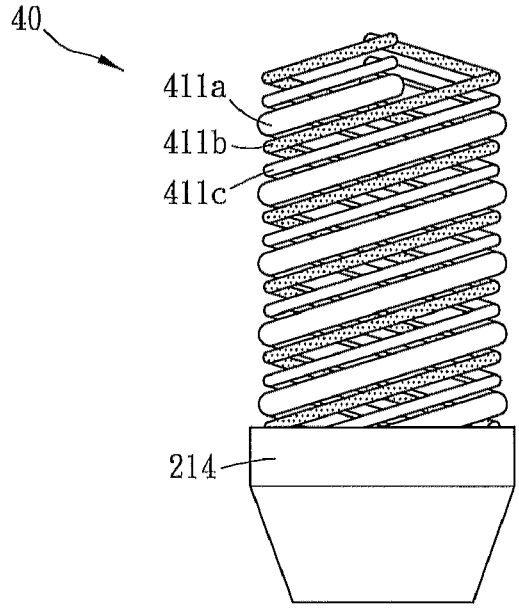
FIG. 4 is a schematic illustration showing another aspect of the fluorescent lamp according to the embodiment of the present invention.

FIG. 4 is a schematic illustration showing another aspect of a fluorescent lamp 40 according to the embodiment of the present invention. As shown in FIG. 4, the fluorescent lamp 40 includes a first lighting element 411*a*, a second lighting element 411*b* and a third lighting element 411*c*, which are independently controlled by different driving devices for controlling the lighting illuminations thereof. In this aspect, each of the first, second and third lighting elements 411*a*, 411*b*, 411*c* is tube-shaped, and the inner surfaces thereof are coated with the fluorescent materials, which can emit the color lights with different color temperatures. For example, the fluorescent materials can emit red light, blue light and green light, respectively. Accordingly, the color of the light emitted by the fluorescent lamp 40 can be controlled by adjusting the lighting illuminations of the first, second and third lighting elements 411*a*, 411*b*, 411*c*.

Figure 5:
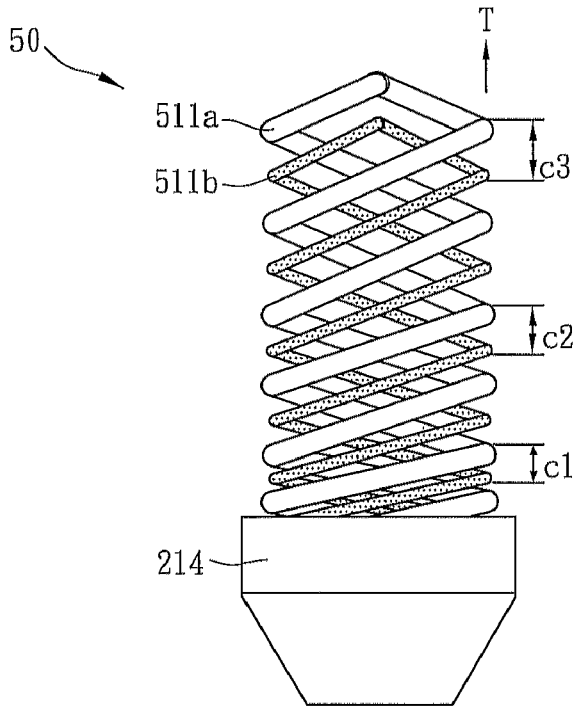
FIG. 5 is a schematic illustration showing another aspect of the fluorescent lamp according to the embodiment of the present invention.

FIG. 5 is a schematic illustration showing another aspect of a fluorescent lamp 50 according to the embodiment of the present invention. The fluorescent lamp 50 of FIG. 5 is similar to the fluorescent lamp 20 of FIG. 2A, and the difference therebetween is in that the gap c1, gap c2 and gap c3 are different from each other. Herein, the gap c1 between the first and second lighting elements 511*a*, 511*b* is close to the base 214, the gap c2 between the first and second lighting elements 511*a*, 511*b* is in the middle of the fluorescent lamp 50, and the gap c3 between the first and second lighting elements 511*a*, 511*b* is close to a top direction T, which is away from the base 214. Preferably, the gaps c1, c2 and c3 have the relationship of c1<c2<c3. The gap between the first and second lighting elements 511*a*, 511*b* gradually increases, as the gap c1 closed to the base 214 to the gap c3 closed to the direction T, so that the lighting illumination of the fluorescent lamp 50 can be more uniform.

Figure 6:
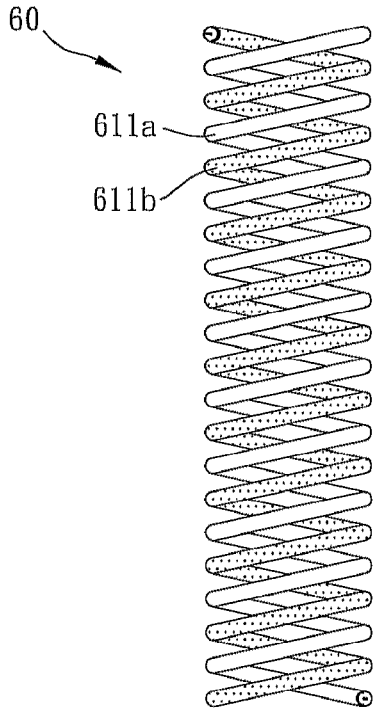
FIG. 6 is a schematic illustration showing another aspect of the fluorescent lamp according to the embodiment of the present invention.

FIG. 6 is a schematic illustration showing another aspect of a fluorescent lamp 60 according to the embodiment of the present invention. As shown in FIG. 6, the fluorescent lamp 60 includes a first lighting element 611*a* and a second lighting element 611*b*, which are made of glass tubes. The first and second lighting elements 611*a*, 611*b* are spirally interlaced with each other, and they have spiral structures with the same spiral cycle number and spiral diameter. The inner surfaces of the first and second lighting elements 611*a*, 611*b* are coated with the fluorescent materials, which can emit lights of different color lights. In addition, the lighting illuminations of the first and second lighting elements 611*a*, 611*b* can be independently controlled. Thus, the color of the light emitted from the fluorescent lamp 60 can be adjusted according to the need of the user.

Figure 7:
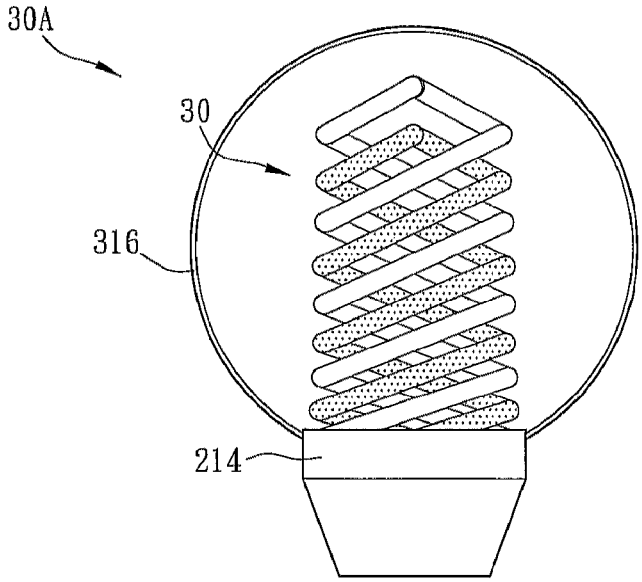
FIG. 7 is a schematic illustration showing the fluorescent lamp including a cover according to the embodiment of the present invention.

FIG. 7 is a schematic illustration showing a fluorescent lamp 30A according to the embodiment of the present invention. The fluorescent lamp 30A of FIG. 7 is similar to the fluorescent lamp 30 of FIG. 3A, and the difference therebetween is in that the fluorescent lamp 30A further includes a cover 316 connected with the base 214. Accordingly, the light emitted from the fluorescent lamp 30A can be further mixed so as to obtain the effect of better light uniformity.

In the fluorescent lamp 30A of FIG. 7, a surface of the cover 316 is formed by a semiopaque material. In the embodiment, the semiopaque material includes silica gel, rubber, epoxy resin, bakelite resin, thermosetting amide, polyvinyl chloride (PVC), polypropylene (PP), polymethylmethacrylate (PMMA), polycarbonate (PC), quartz or glass. Alternatively, the surface of the cover 316 can include a diffusion particle, which can be the material having an extinction coefficient of zero. For example, the diffusion particle can be titanium dioxide, silicon dioxide, talcum, mica, magnesium oxide, barium sulfate or zinc sulfide. To be noted, the examples of the semiopaque material or the diffusion particle are not limited to the above-mentioned materials, and they can be other material that can achieve the effect of mixing light. The appearance of the cover 316 is not limited to the ball shape as shown in FIG. 6, and it can be other shape such as cone-shaped, cylindrical, elliptical ball-shaped or rectangular parallelepiped-shaped.

In the above-mentioned embodiment, the side surface of the fluorescent lamp can have an outline of a cylinder surface, a cone surface, a bowl surface, a tetragonal column surface or a hexagonal column surface.

In summary, the fluorescent lamp of the present has at least two lighting elements for emitting the lights of different colors, and the lighting illuminations thereof can be independently controlled. Thus, the color of the light emitted by the fluorescent lamp can be adjusted.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fluorescent lamp comprising:

a first lighting element and a second lighting element; a base; a first driving device and a second driving device connected to and independently controlling lighting illuminations of the first and second lighting elements, respectively, and disposed in the base;

wherein the first and second lighting elements emit light of different color temperatures but have spiral structures with the same spiral diameter and are spirally interlaced with each other, a distance of each spiral structure to a vertical axis passing through a center of the spiral structures being the same, and a gap between the first and second element, that gradually increases such that the gap is larger away from the base than closer to the base and when viewed in a direction perpendicular to the vertical axis tops of the first and second lighting elements are S-shaped, and one of the tops is below the other one of the tops.

2. The fluorescent lamp according to claim 1, wherein the first and second lighting elements have the same spiral cycle number.

3. The fluorescent lamp according to claim 1, further comprising a third lighting element and a third driving device, wherein the third lighting element is connected to the third driving device and has a spiral structure with the same spiral cycle number and spiral diameter as that of the first and second lighting elements, and the first, second and third lighting elements are spirally interlaced with each other.

4. The fluorescent lamp according to claim 3, further comprising a base, wherein the first, second and third driving devices are disposed in the base.

5. The fluorescent lamp according to claim 3, wherein a gap between parts of the first, second and third lighting elements away from the base is larger than that close to the base.

6. The fluorescent lamp according to claim 5, wherein the gap between the first, second and third lighting elements gradually increases.

7. The fluorescent lamp according to claim 3, wherein the third driving device independently controls a lighting illumination of the third lighting element.

8. The fluorescent lamp according to claim 7, wherein the first, second and third lighting elements emits red, blue and green lights, respectively.

9. The fluorescent lamp according to claim 1, further comprising a cover connected to the base.

10. The fluorescent lamp according to claim 9, wherein a surface of the cover comprises a semiopaque material.

11. The fluorescent lamp according to claim 10, wherein the semiopaque material comprises silica gel, rubber, epoxy resin, bakelite resin, thermosetting amide, polyvinyl chloride (PVC), polypropylene (PP), polymethylmethacrylate (PMMA), Polycarbonate (PC), quartz or glass.

12. The fluorescent lamp according to claim 9, wherein a surface of the cover comprises a diffusion particle.

13. The fluorescent lamp according to claim 12, wherein an extinction coefficient of the diffusion particle is zero.

14. The fluorescent lamp according to claim 12, wherein the diffusion particle comprises titanium dioxide, silicon dioxide, talcum, mica, magnesium oxide, barium sulfate or zinc sulfide.

15. The fluorescent lamp according to claim 1, wherein tube diameters of the first lighting element and the second lighting element range from 1.8 to 40 mm.

16. A fluorescent lamp comprising:

a first lighting element; and a second lighting element; wherein the first and second lighting elements have spiral structures with the same spiral diameter and the same spiral cycle number, a distance of each spiral structure to a vertical axis passing through a center of the spiral structures being the same, a gap between the first and second element, that gradually increases such that the gap is larger away from the base than closer to the base.

17. The fluorescent lamp according to claim 1, wherein the first lighting element includes a tube and the second lighting element includes a tube, the first and second lighting elements have a same spiral cycle number, and a tube diameter of the first lighting element is different from a tube diameter of the second lighting element.

* * * * *